US007798049B2

(12) United States Patent
Willis, Jr.

(10) Patent No.: US 7,798,049 B2
(45) Date of Patent: Sep. 21, 2010

(54) ELECTROMECHANICAL FIREARM REST

(76) Inventor: Clifford Craig Willis, Jr., 1900 Shep Willis Rd., Morehead City, NC (US) 28557

( * ) Notice: Subject to any disclaimer, the term of this patent is extended or adjusted under 35 U.S.C. 154(b) by 545 days.

(21) Appl. No.: 11/700,644

(22) Filed: Jan. 31, 2007

(65) Prior Publication Data

US 2009/0205238 A1 Aug. 20, 2009

Related U.S. Application Data

(60) Provisional application No. 60/763,573, filed on Jan. 31, 2006.

(51) Int. Cl.
*F41A 23/16* (2006.01)

(52) U.S. Cl. ..... 89/37.04; 42/94
(58) Field of Classification Search ..... 42/94; 89/37.04
See application file for complete search history.

(56) References Cited

U.S. PATENT DOCUMENTS 4,790,096 A * 12/1988 Gibson et al. ..... 42/94
6,009,791 A * 1/2000 Medlin ..... 89/38
6,679,158 B1 * 1/2004 Hawkes et al. ..... 89/41.05

* cited by examiner

*Primary Examiner*—Stephen M Johnson
(74) *Attorney, Agent, or Firm*—Timothy M. Barlow

(57) ABSTRACT

An electromechanical firearm rest may include a base plate with a front rest attached to the base plate. An electromechanical windage adjustment mechanism and an electromechanical elevation adjustment mechanism may be attached to the front rest or the base plate. A wired or wireless controller may be in communication with both the electromechanical windage adjustment mechanism and the electromechanical elevation adjustment mechanism. Inputs may be made through a joystick. The firearm rest may include one or more interchangeable bag tops for the front and rear rests. The base plate may be one-piece or may include a front plate and a rear plate with a removable center section. The electronic controls may include a variable slew rate to adjust both elevation and windage simultaneously. DC motors or servos may be used to physically move and aim the firearm and manual adjusters may permit quick setup.

14 Claims, 3 Drawing Sheets

ELECTROMECHANICAL FIREARM REST

PRIORITY DATA

The present invention claims priority from U.S. provisional patent application Ser. No. 60/763,573, filed on Jan. 31, 2006, entitled "Electromechanical Firearm Rest", and is hereby incorporated by reference.

BACKGROUND OF THE INVENTION

1. Field of the Invention

The present invention relates generally to rifle rests, and more specifically to an electromechanical firearm rest for precision firearms.

2. Description of Related Art

Numerous firearm rests are on the market today. These rests range in scope from basic sandbags to complex mechanical rests having numerous fine adjustments. The most basic rests are found at virtually every firing range in the world. The most complex rests are quite expensive and are found where the utmost in precision shooting is required, such as benchrest rifle matches. In the sport of benchrest rifle, the object is to shoot five or more bullets into as small a space as is possible. This sport is engaged at various distances, from 25 yard to 1000 yards, and beyond. The requirements for the equipment used in these sports may be complex.

The equipment used, whether rifle, rifle rest, ammunition, optics, etc., must be rugged and manufactured to very tight tolerances to virtually eliminate variations from shot-to-shot. A big part of the shot-to-shot variation is the rifle rest itself. After each shot, the rifle recoils out of its original position. There are practical limits on how much a rest can weigh and regulated limits on how the firearm is secured to the rest. Thus, some recoil movement is inevitable. The key for the shooter is to return the firearm to the exact same position and orientation for each shot as quickly as possible. Mechanically returning the firearm to the same position and orientation will ensure that the firearm is pointing at precisely the same place on the target. Performing this task quickly ensures that wind direction and velocity will not have much of an opportunity to change between shots.

It is possible to move the firearm back to its starting position and orientation manually. This has been the only way it was done until now. However, human inputs are often inconsistent and prone to causing inaccuracy. This is because human inputs can put the firearm back into the same apparent position and orientation, but may do so via a slightly different pathway each time. These different pathways introduce small variations in the stresses and strains in the firearm and rest system. These small stress and strain variations all add up to create minor shot-to-shot variations that lead to inaccuracy and imprecision that can be measured.

Thus, what is needed is an electromechanical firearm rest that virtually eliminates the various stresses and strains between the firearm and rest induced through inconsistent, manual, human inputs to enable the firearm to shoot at the most accurate and precise level possible.

A portable electromechanical firearm rest system with virtual-reality game like controls and method solving the aforementioned problems is desired.

SUMMARY OF THE INVENTION

The present invention is therefore directed to an electromechanical firearm rest that that provides electromechanical inputs to adjust windage and elevation for a firearm, which substantially overcomes one or more of the problems due to the limitations and disadvantages of the related art.

It is a feature of the invention to provide an electromechanical firearm rest that eliminates manual firearm rest adjustments.

It is a feature of the invention to provide an electromechanical firearm rest that eliminates the need for a dedicated firearm rest for each shooting discipline.

Still another feature of the invention is to provide an electromechanical firearm rest that provides a simple, rugged and quick way to return a firearm into the same position and orientation time and again.

It is a feature of the invention to provide improved elements and arrangements thereof for the purposes described which is inexpensive, dependable and fully effective in accomplishing its intended purposes.

According to aspects of the present invention, there is provided an electromechanical firearm rest. The electromechanical firearm rest may include a base plate. A front rest may be attached to the base plate. An electromechanical windage adjustment mechanism may be attached to the front rest, and an electromechanical elevation adjustment mechanism may be attached to the base plate. A controller may be in communication with both the electromechanical windage adjustment mechanism and the electromechanical elevation adjustment mechanism.

In some example embodiments of the present invention, the electromechanical firearm rest may include a one-piece base plate.

In some example embodiments of the present invention, the electromechanical firearm rest may include a multiple-piece base. The multiple-piece base may include a removable center.

In some example embodiments of the present invention, the electromechanical firearm rest may include separate front and rear base plates, and rests.

In some example embodiments of the present invention, the electromechanical firearm rest may include a front rest. The front rest may be used with or without the electromechanical controls.

In some example embodiments of the present invention, the electromechanical firearm rest may include an elevation post for the front rest with both fine and coarse adjustment capability.

In some example embodiments of the present invention, the electromechanical firearm rest may include windage mechanisms installed on both the front and rear rests for multiple setup options and maximum control and adjustment.

In some example embodiments of the present invention, the electromechanical firearm rest may include one or more dc motors, e.g., servos, attached to the front windage or elevation mechanisms.

In some example embodiments of the present invention, the electromechanical firearm rest may include an anti-backlash nut installed on the windage or elevation adjustment mechanisms.

In some example embodiments of the present invention, the electromechanical firearm rest may include a joystick controller for the motors.

In some example embodiments of the present invention, the electromechanical firearm rest may include a fine elevation adjustment mechanism attached to the front rest and the motor.

In some example embodiments of the present invention, the joystick may control both the windage and elevation mechanisms simultaneously.

In some example embodiments of the present invention, the joystick may control both the windage and elevation mechanisms with variable speed.

In some example embodiments of the present invention, both the front and rear base plates may have manual vertical adjusters with fine threads.

In some example embodiments of the present invention, the both the front and rear bases may have individually adjustable tripod feet In some example embodiments of the present invention, the electromechanical firearm rest may include an integral level indicator.

In some example embodiments of the present invention, the electromechanical firearm rest may include multiple, interchangeable bag tops for different rifle sizes and shapes.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

Similar reference characters denote corresponding features consistently throughout the attached drawings.

DETAILED DESCRIPTION OF THE DRAWINGS

Figure 1:
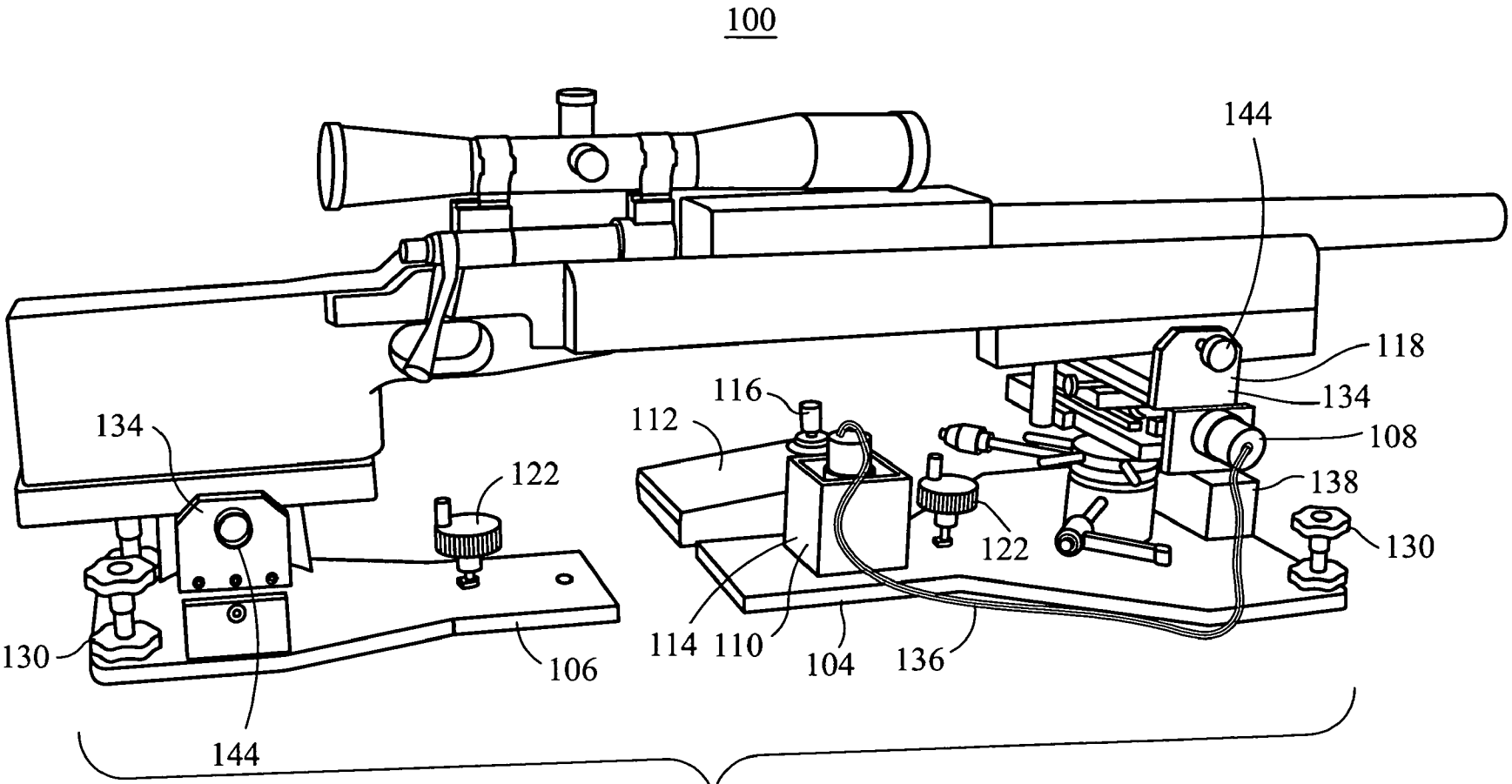
FIG. 1 illustrates an elevated rear perspective view of an electromechanical firearm rest system, according to the present invention.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like reference numerals refer to like elements throughout. As used herein, the term "and/or" includes any and all combinations of one or more of the associated listed items.

Spatially relative terms, such as "beneath," "below," "lower," "above," "upper" and the like, may be used herein for ease of description to describe one element or feature's relationship to another elements or features as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented rotated 90 degrees or at other orientations and the spatially relative descriptors used herein interpreted accordingly.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
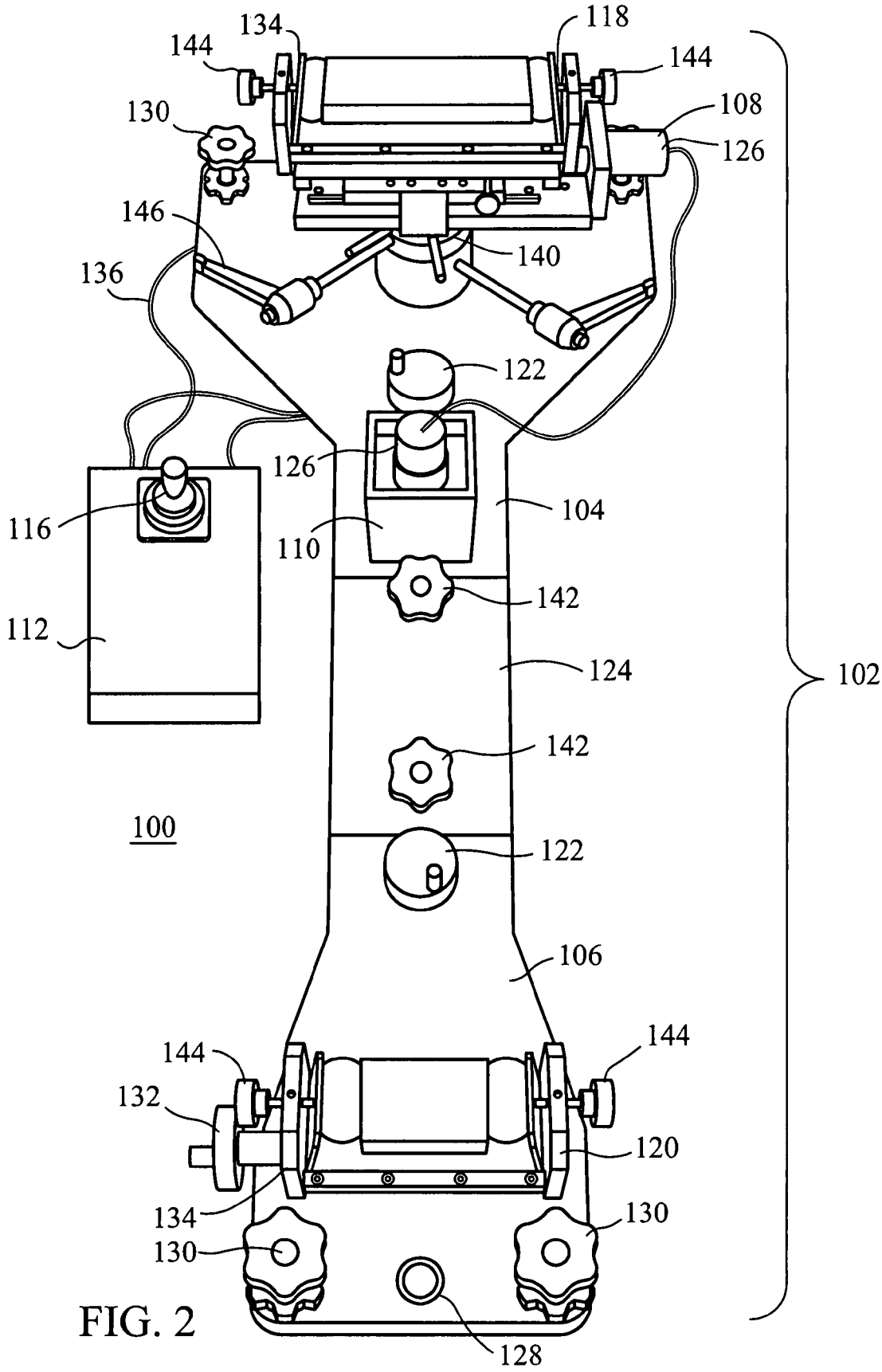
FIG. 2 illustrates an elevated side perspective view of an electromechanical firearm rest system, according to the present invention.
Figure 3:
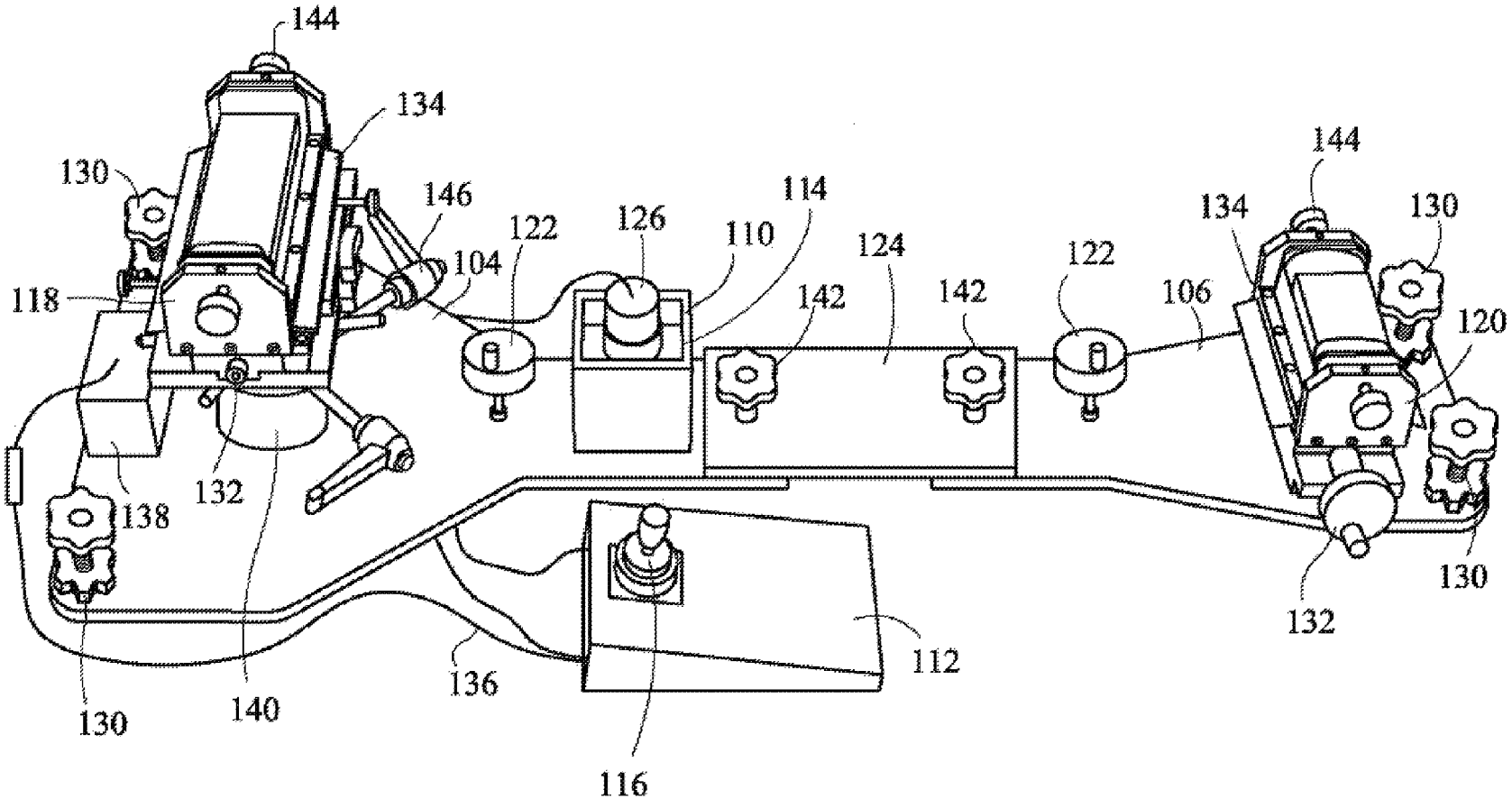
FIG. 3 illustrates a side view of an electromechanical firearm rest, according to the present invention.

FIGS. 1-3 illustrate rear, side and elevated views exemplary embodiments of an electromechanical firearm rest system.

An electromechanical firearm rest 100 includes a base plate 102. The base plate 102 may be a single piece unit or may include two or more separate pieces that may be attached together with screws 142 to form a single unit. FIG. 1 illustrates a three-piece base 102 where the center base plate 124 is removed to leave only the front rest 104 and rear rest 106. The front rest 104 may include an electromechanical windage adjustment mechanism 108 and an electromechanical elevation adjustment mechanism 110 attached to the front rest 104. A controller 112 may be connected to the windage and elevation adjustment mechanisms 108, 110. The controller 112 may be hardwired or may be in wireless communication with both the windage and elevation adjustment mechanisms 108, 110. Batteries 138 or another power source may be attached to only the controller 112 for the hardwired controller, but may be attached to both the controller 112 and the wireless receiver 114 for the wireless version. Cables 136 with quick connectors may make setup fast and easy.

A wireless controller 112 may be in communication with a wireless receiver 114 to receive and process signals from the controller 112 to the windage and elevation adjustment mechanisms 108, 110. The controller 112 may include a joystick 116 to make windage and elevation adjustments quick and easy. Both elevation and windage may be adjusted simultaneously. The joystick 116 may be programmed to provide progressive response to joystick deflections, e.g., a fast response for a large joystick deflection, and a small or slow response for a small joystick deflection. The controller 112 may be setup up for right hand or left hand operation.

Various types of firearms may be used from atop the electromechanical firearm rest 100. Thus, a variety of interchangeable bag tops for the front 118 and the rear 120 may be employed atop the front rest 104 and rear rest 106, respectively. The bag tops 118, 120 may include clamps 134, 144 to apply pressure to a sandbag in the bag top 118, 120.

The windage mechanism 132 may include an acme screw with bearing blocks, rails and motor 126. Anti backlash mechanisms may be used to reduce or eliminate any backlash movement of the interchangeable bag tops 118. Rails with pillar blocks having stainless steel bearings may be used for smooth operation and more predictable and uniform return-to-battery.

A manual windage knob may be provided for manual windage adjustment 132 (see FIG. 3).

The electromechanical elevation adjustment mechanism 110 may include a fine resolution screw with motor for electronic vertical adjustment at the front and/or the rear rests 104, 106. A coarse 140 or fine 122 manual elevation adjustment screw may help to preserve electromechanical elevation adjustment range and allow the user to aim the firearm more quickly onto the target when setting up the equipment for use. A locking knob 146 may temporarily disable the coarse manual elevation adjustment mechanism 140 to prevent inadvertent movement.

The removable center plate 124 may attach the front rest 104 to the rear rest 106 to create a one-piece base 102. Many competition rules do not allow single-piece bases, but this feature may be helpful when first setting up the equipment, e.g., the center plate 124 may ensure that the front rest 104 and the rear rest 106 are parallel during set up. Alignment flanges may be incorporated into the interface between the center plate 124 and the front and rear rests 104, 106 to ensure the front and rear rests 104, 106 are parallel. In addition, the front rest 104 and the rear rest 106 may include bubble or spirit level 128 to repeatable position the entire electromechanical firearm rest system 100 every time it is used. Once both the front and rear rests 104, 106 are leveled, the center plate 124 may be removed to create a two-piece base. This may be important depending on the rules of a particular competition.

The front rest 104 and the rear rest 106 may be separately or collectively leveled via a number of leveling knobs 130 around the periphery of the front and rear bases 104, 106. The front rest 104 or the rear rest 106 may be used separately to meet the needs of the user or to conform to rules of competition.

The front rest 104 may include a manual windage adjustment to permit the user to put his firearm on target quickly without using all of the adjustment range of the electromechanical windage adjustment mechanism 108.

The electromechanical windage and elevation adjustment mechanisms 108, 110 may use dc motors or servos, with high torque and low speed to move the firearm.

The user may thus make quick adjustments to the position of the firearm without handling the firearm excessively. A single joystick control means that the user may make rapid or slow (variable speed) electromechanical adjustment of both windage and elevation simultaneously. The variable speed motors 126 may be used for both windage and elevation adjustment simultaneously to reduce the amount of time between shots. The joystick 116 permits the user to use a single input to control both the windage and the elevation. This is unknown in small arms competition.

The quick detachable tops may allow for different classes of firearms to use a single rest system 100. The system 100 may be setup for manual, hardwired electromechanical or wireless remote control electromechanical operations.

The rear rest 106 may include a manual windage mechanism 132 with acme screw, anti backlash nut, bearing blocks and stainless rails. A bag holder 120 may be attached to attach interchangeable and removable bag tops. The manual windage knob 132 for manual windage adjustment of the rear rest 106 may be used in concert with the windage adjustment 132 on the front rest 104 for fast set up.

Operation

The system may be assembled at the firing range to make it easy to handle. The single base 102 or separate front and rear bases 104, 106 may be placed atop the shooting bench or designated firing position. The separate front and rear rests 104, 106 with removable center plate 124 may have several advantages. The removable center plate 124 may control the spacing between the front and rear rests 104, 106. The removable center plate 124 may align the front and rear rests 104, 106 and align the entire system and rifle with target. It may also enable the front base 104 to be used independently of rear plate 106 and center plate 124 to meet the rules of competition. Further, the multiple length center plates 124 may be used for different length firearms or other conditions. However, the one-piece plate 102 may be used for the heavy gun class or other disciplines.

The bases 104, 106 may be made parallel and level, and oriented toward the target. The appropriate bag tops may be installed, front and/or rear, and a firearm may be placed atop the bag tops. The coarse 140 or manual 122, 132 adjustments may be used, front and/or rear, to get the firearm on target. The electromechanical controls may be used to fine-tune the firearm's aiming.

The electromechanical firearm rest system 100 uses electromechanical controls. Through a joystick control 116, the user may input windage and elevation adjustments simultaneously through two electric motors 126 on the front rest 104. The system 100 may provide simultaneous operation of both motors 126 for windage and/or elevation, and may provide variable speed control for each input. The system 100 may allow for the fast positioning of the firearm with minimal body/hand movement. This may improve both short and long range accuracy shooting. Due to the limited amount of contact the shooter may have with the firearm, the device may aid in shooting using the free recoil technique.

The system 100 may be powered by a battery 138 with a charger, or may include an AC adapter where other power supplies are available. Quick connectors for all wires 136 may allow for quick and easy assembly and disassembly. Other embodiments may include a power switch and a calibration button on the control box 112. A power light may also be included to alert the user that power is on or to alert the user to a low battery condition.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

I claim:

1. An electromechanical firearm rest comprising:

a base plate including a front plate, a rear plate and a center plate, where the center plate, where the center plate is removably attached between the front plate and the rear plate;

a front rest for supporting a front of a firearm attached to the base plate;

a rear rest for supporting a rear of the firearm attached to the base plate, wherein the rear rest is independently operable from the front rest;

an electromechanical windage adjustment mechanism attached to the front rest;

an electromechanical elevation adjustment mechanism attached to the front rest of the base plate; and a controller in communication with both the electromechanical windage adjustment mechanism and the electromechanical elevation adjustment mechanism, wherein adjustment of the front rest for windage and elevation does not affect the orientation of the rear rest.

2. The electromechanical firearm rest of claim 1, further comprising one or more interchangeable bag tops for the front rest to accommodate different rifle sizes and shapes.

3. The electromechanical firearm rest of claim 1, further comprising one or more interchangeable bag tops for the rear rest to accommodate different rifle sizes and shapes.

4. The electromechanical firearm rest of claim 1, where the electromechanical windage adjustment mechanism comprises a variable slew rate.

5. The electromechanical firearm rest of claim 1, where the electromechanical elevation adjustment mechanism comprises a variable slew rate.

6. The electromechanical firearm rest of claim 1, where the controller is hardwired to the elevation and windage adjustment mechanisms.

7. The electromechanical firearm rest of claim 1, further comprising a wireless receiver attached to the elevation and windage adjustment mechanisms; and where the controller comprises a wireless transmitter in wireless communication with the wireless receiver.

8. The electromechanical firearm rest of claim 1, where the controller comprises a joystick input mechanism.

9. The electromechanical firearm rest of claim 1, where the windage adjustment mechanism comprises DC motor.

10. The electromechanical firearm rest of claim 1, where the elevation adjustment mechanism comprises DC motor.

11. The electromechanical firearm rest of claim 1, where the controller is capable of adjusting elevation and windage simultaneously.

12. The electromechanical firearm rest of claim 1, further comprising a manual elevation adjustment mechanism.

13. The electromechanical firearm rest of claim 1, further comprising a rear windage adjustment mechanism attached to the rear rest.

14. The electromechanical firearm rest of claim 1, further comprising a rear elevation adjustment mechanism attached to the rear plate.

* * * * *